US010231557B2

(12) United States Patent
Wilke

(10) Patent No.: US 10,231,557 B2
(45) Date of Patent: Mar. 19, 2019

(54) BALLOON DISPLAY STRUCTURE

(71) Applicant: David Wilke, Franklin, WI (US)

(72) Inventor: David Wilke, Franklin, WI (US)

( * ) Notice: Subject to any disclaimer, the term of this patent is extended or adjusted under 35 U.S.C. 154(b) by 0 days.

(21) Appl. No.: 15/822,769

(22) Filed: Nov. 27, 2017

(65) Prior Publication Data

US 2018/0078057 A1 Mar. 22, 2018

Related U.S. Application Data

(62) Division of application No. 15/176,883, filed on Jun. 8, 2016, now abandoned.

(51) Int. Cl.

| | |
|---|---|
| ***A47F 7/00*** | (2006.01) |
| ***A47F 5/11*** | (2006.01) |
| ***A47F 5/04*** | (2006.01) |

(52) U.S. Cl.

CPC ..... *A47F 7/0028* (2013.01); *A47F 5/04* (2013.01); *A47F 5/112* (2013.01)

(58) Field of Classification Search

CPC ..... A47F 7/0028; A47F 5/112; A47F 5/11; A47F 5/04; A63H 27/10

USPC ..... 206/736, 756, 763; 446/220

See application file for complete search history.

(56) References Cited

U.S. PATENT DOCUMENTS

| | | | | | |
|---|---|---|---|---|---|
| 814,069 | A * | 3/1906 | Naylor | B65D 5/4802 | 229/120.15 |
| 1,266,749 | A * | 5/1918 | Abbott | A47F 5/04 | 211/196 |
| 1,710,543 | A * | 4/1929 | Leo | B65D 5/5045 | 206/418 |
| 1,821,580 | A * | 9/1931 | Rogers | G09F 7/00 | 248/188.1 |
| 1,946,779 | A * | 2/1934 | Conway | A47F 5/112 | 248/174 |
| 2,019,801 | A * | 11/1935 | Songer | A47G 23/0208 | 211/41.2 |
| 2,063,393 | A * | 12/1936 | McIver | A47F 5/04 | 211/123 |
| 2,152,079 | A * | 3/1939 | Mott | B65D 5/5253 | 206/558 |
| 2,229,427 | A * | 1/1941 | Tanner | A47F 5/112 | 206/277 |
| 2,597,157 | A | 5/1952 | Martino | | |
| 2,609,136 | A * | 9/1952 | Sider | B65D 5/505 | 108/51.3 |
| 2,818,254 | A * | 12/1957 | Dunn | A63B 63/083 | 248/910 |

(Continued)

FOREIGN PATENT DOCUMENTS

| | | |
|---|---|---|
| JP | 2007008575 | 1/2007 |
| JP | 2007008575 A * | 1/2007 |

OTHER PUBLICATIONS

Borosino Balloon Display Product Pages, http://www.borosino.com, 2 pages, date unknown.

*Primary Examiner* — Jonathan Liu
*Assistant Examiner* — Devin K Barnett
(74) *Attorney, Agent, or Firm* — Ryan Kromholz & Manion, S.C.

(57) ABSTRACT

A balloon display structure and method of use. The display structure includes a base member and an upstanding member with the upstanding member having a plurality of sides with elongate apertures therein. The elongate apertures are arranged to receive sticks bearing air-filled balloons.

6 Claims, 6 Drawing Sheets

(56) References Cited

U.S. PATENT DOCUMENTS 3,026,641 A * 3/1962 Keats ..... B65D 88/12 248/125.8
3,058,583 A * 10/1962 Williams ..... B42F 17/02 206/425
3,069,192 A * 12/1962 Hankus ..... A47G 33/06 338/32 S
3,076,557 A 2/1963 Husted
3,119,588 A * 1/1964 Keats ..... E01F 13/02 116/173
3,199,765 A * 8/1965 Locke ..... B65D 5/02 206/395
3,263,820 A * 8/1966 McFadden ..... A61M 5/008 211/60.1
3,281,102 A * 10/1966 Hobson ..... A47B 57/42 108/108
3,286,830 A * 11/1966 Robb, Jr. ..... B65D 5/725 206/264
3,524,616 A * 8/1970 Marschak ..... A47B 57/425 211/205
3,612,287 A * 10/1971 Maltese ..... A47F 5/04 211/182
3,901,389 A * 8/1975 Belokin, Jr. ..... A47F 5/04 211/74
3,931,916 A * 1/1976 Blue ..... B65D 5/46032 222/465.1
D239,744 S 5/1976 Bucknam
3,982,682 A * 9/1976 Fremion ..... B65D 5/5033 206/586
4,038,777 A * 8/1977 Schwartz ..... A63H 27/10 244/30
4,138,055 A * 2/1979 Harrison ..... B42D 17/00 232/1 C
4,232,846 A * 11/1980 Bressani ..... E04H 12/2238 248/158
4,248,350 A * 2/1981 Gilbert ..... B65D 5/5033 206/320
4,267,995 A * 5/1981 McMillan ..... H02G 3/32 174/153 G
4,399,915 A * 8/1983 Sorenson ..... B65D 5/5033 206/453
4,432,454 A * 2/1984 Bloom ..... B65D 5/50 206/425
4,491,856 A 1/1985 Egawa et al.
4,530,459 A * 7/1985 Maroszek ..... B65D 5/46096 229/117.12
4,644,610 A * 2/1987 Fish ..... A01G 13/04 211/70.6
D290,823 S * 7/1987 Gardiner ..... D11/184
4,813,902 A * 3/1989 Messer ..... B42D 15/02 40/124.15
4,830,272 A * 5/1989 Wear ..... B65D 5/4802 229/120.07
4,879,823 A * 11/1989 Collins ..... A63F 9/00 40/124.01
4,941,856 A * 7/1990 Lovik ..... A63H 27/10 403/292
4,944,709 A * 7/1990 Lovik ..... A63H 27/10 446/221
4,953,713 A * 9/1990 Yaffe ..... A47F 5/04 206/460
D315,676 S * 3/1991 Snipes ..... D9/720
4,997,403 A * 3/1991 Akman ..... F21V 3/023 362/96
5,024,011 A * 6/1991 Collins ..... A63F 9/00 211/13.1
5,025,936 A * 6/1991 Lamoureaux ..... A47B 73/006 211/74
5,143,210 A * 9/1992 Warwick ..... A61B 10/0096 206/499
5,161,692 A * 11/1992 Knierim ..... B65D 5/32 206/320
5,183,158 A * 2/1993 Boyd ..... B65D 33/001 206/554
5,220,740 A * 6/1993 Brault ..... F16M 11/42 248/910
5,354,031 A * 10/1994 Bilotti ..... E04H 12/2238 248/511
5,373,939 A * 12/1994 Bloomgren ..... A47F 7/0028 206/341
D371,574 S * 7/1996 Barton ..... D19/2
D381,534 S 7/1997 Gameau
D385,716 S 11/1997 Hudson
5,685,438 A * 11/1997 Emanuel ..... A47F 7/0028 206/486
5,730,668 A * 3/1998 Hege ..... A63B 71/023 206/315.9
5,755,325 A * 5/1998 Willhite ..... A47F 7/0028 206/443
5,755,419 A * 5/1998 Gearhart ..... A63H 27/10 248/176.1
5,797,783 A * 8/1998 Harris ..... A63H 27/10 40/124.05
5,938,154 A * 8/1999 Bartels ..... A63H 27/10 248/176.1
6,012,587 A * 1/2000 McCullough ..... B65D 71/0096 206/453
6,050,874 A * 4/2000 Ries ..... A63H 27/10 446/220
6,056,120 A * 5/2000 Hollingsworth ..... A47F 5/11 206/562
6,082,368 A * 7/2000 Brown ..... A23G 3/36 131/270
D435,740 S * 1/2001 Han ..... D6/405
D449,525 S * 10/2001 Sturgess ..... D9/432
D450,474 S 11/2001 Sokoloff
D463,160 S 9/2002 Chang
6,446,930 B1 * 9/2002 Li ..... E04H 12/2238 135/15.1
D470,689 S 2/2003 High
6,513,662 B1 * 2/2003 Stebelton ..... B65D 81/054 206/586
6,523,798 B1 * 2/2003 Novak ..... A63H 27/10 248/176.1
D484,303 S * 12/2003 Taylor ..... D3/10
D492,137 S * 6/2004 Siegel ..... D6/677
6,745,904 B1 * 6/2004 Komar ..... A47F 5/01 211/13.1
6,779,670 B2 * 8/2004 Primiano ..... A47F 1/12 211/175
6,971,511 B2 * 12/2005 Holmon ..... B65D 5/0254 206/232
6,986,496 B2 * 1/2006 Roberts ..... E04H 12/2246 248/519
D514,437 S * 2/2006 Kim ..... D9/416
D521,875 S * 5/2006 Barton ..... D9/721
D522,381 S * 6/2006 Barton ..... D9/720
7,137,517 B2 * 11/2006 Lowry ..... B65D 5/5033 211/188
7,159,721 B2 * 1/2007 Martin, Jr. ..... B65D 5/4208 206/485
D542,346 S * 5/2007 Barton ..... D19/2
D551,547 S * 9/2007 Wachendorf ..... D9/418
D551,969 S * 10/2007 Aurilio ..... D9/418
D555,944 S 11/2007 Quintal
D567,541 S 4/2008 Bermea
D575,599 S * 8/2008 Ignozzi ..... D7/701
7,614,600 B1 * 11/2009 Smith ..... G09F 23/00 135/16
D605,428 S 12/2009 Brooks
7,631,773 B1 12/2009 Calabrisotto
7,669,355 B2 * 3/2010 Gronenthal ..... G09F 23/00 40/606.19
D616,740 S * 6/2010 Akers ..... D9/432
7,819,373 B1 * 10/2010 Tsai ..... F16M 11/10 248/346.2
D627,001 S * 11/2010 de Niet ..... D20/22
7,854,642 B2 * 12/2010 Nelson ..... A63H 27/10 248/309.1

(56) References Cited

U.S. PATENT DOCUMENTS

D634,793 S * 3/2011 Goodman-Pollack ..... D21/453
D643,255 S 8/2011 Tsai
D658,236 S * 4/2012 Dalfonzo ..... D21/453
D659,200 S * 5/2012 Wicken ..... D21/440
D659,915 S * 5/2012 Letchford ..... D21/440
8,336,713 B2 * 12/2012 Poitevin ..... B65D 5/5445 206/485
D675,490 S * 2/2013 Dara ..... D7/701
D688,318 S * 8/2013 Dalfonzo ..... D21/453
8,640,889 B2 * 2/2014 Gasper ..... A47B 73/00 211/74
8,968,047 B1 * 3/2015 Wicken ..... F16M 11/16 211/13.1
9,089,784 B2 * 7/2015 Nelson ..... A63H 27/10
D740,546 S * 10/2015 Devaney ..... D3/10
9,185,984 B2 * 11/2015 Henke ..... A47B 47/0008
D758,182 S * 6/2016 Sponselee ..... D9/423
D765,447 S 9/2016 Barham
9,783,333 B1 * 10/2017 De Los Santos ..... B65D 5/006
D805,928 S 12/2017 Ben Josef
9,833,722 B2 * 12/2017 Wicken ..... A63H 27/10
9,861,462 B2 * 1/2018 Sholev ..... A61F 2/0063
D825,353 S 8/2018 Wojciechowski
2003/0015640 A1 * 1/2003 Novak ..... B44C 5/00 248/346.01
2003/0024848 A1 * 2/2003 Oycke ..... B65D 5/5021 206/526
2004/0056169 A1 * 3/2004 Harbaugh ..... E04H 12/2246 248/519
2004/0232040 A1 * 11/2004 Bowling ..... A63F 9/0495 206/775
2005/0178788 A1 * 8/2005 Shannon ..... G07F 11/045 221/199
2005/0199774 A1 * 9/2005 Reese ..... A45B 23/00 248/529
2007/0071563 A1 * 3/2007 Snyder ..... B23B 47/287 408/115 R
2008/0067301 A1 * 3/2008 Moss ..... A47F 5/112 248/174
2009/0065389 A1 * 3/2009 Kleinsmith ..... B65D 5/4233 206/457
2010/0219093 A1 * 9/2010 Motadel ..... B01L 3/54 206/443
2010/0252519 A1 * 10/2010 Hanners ..... A47F 5/005 211/184
2011/0311750 A1 * 12/2011 McNeil ..... A47K 10/16 428/43
2012/0312762 A1 * 12/2012 Pierce ..... A63H 27/10 211/13.1
2013/0180941 A1 * 7/2013 Tomaszewski ..... B65D 19/385 211/126.12
2013/0244532 A1 * 9/2013 McNichols ..... A63H 27/10 446/222
2014/0284436 A1 * 9/2014 Erwin ..... A47F 7/0028 248/176.1
2015/0076096 A1 * 3/2015 Brady ..... A47B 87/0253 211/132.1
2015/0213742 A1 * 7/2015 Chapman-Rickman ..... A63H 27/10 446/221
2015/0374146 A1 * 12/2015 LeFevre ..... A47F 7/285 211/85.26
2016/0144993 A1 * 5/2016 George ..... B65D 15/08 229/404
2017/0057721 A1 * 3/2017 Lee ..... A61F 13/5514

* cited by examiner

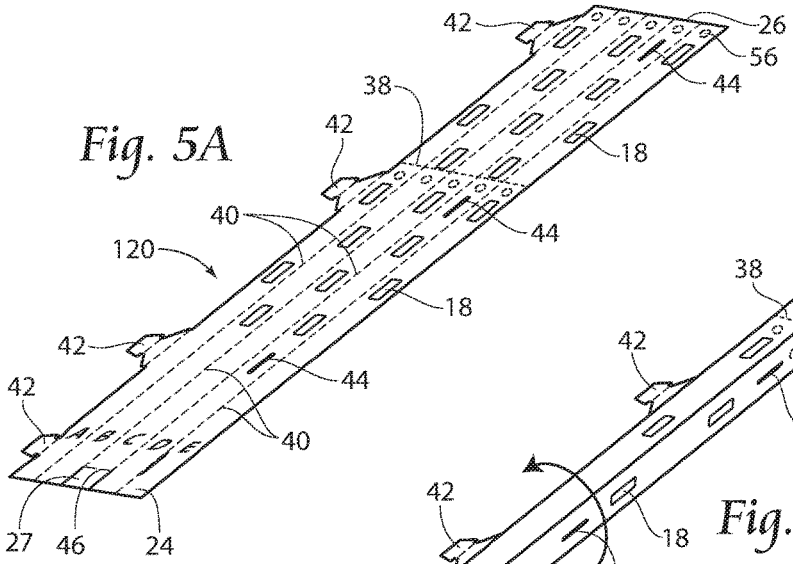
Fig. 5A
Fig. 5B
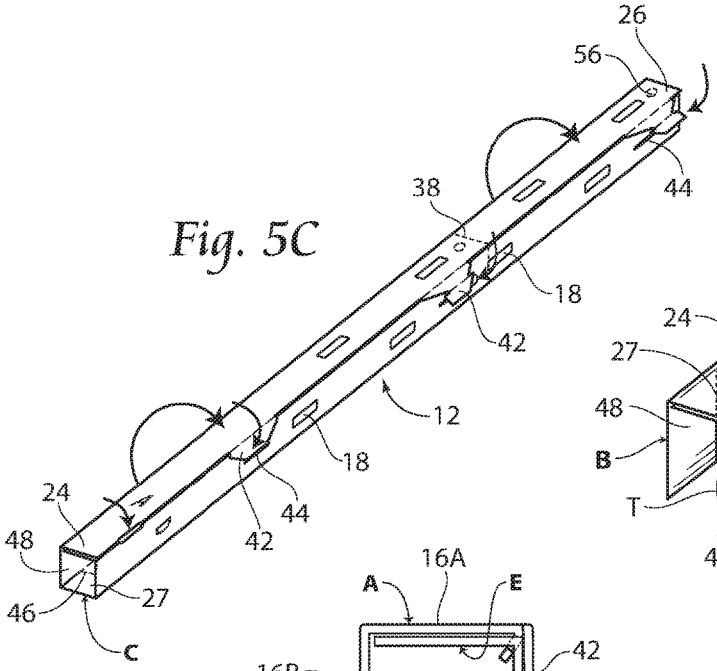
Fig. 5C
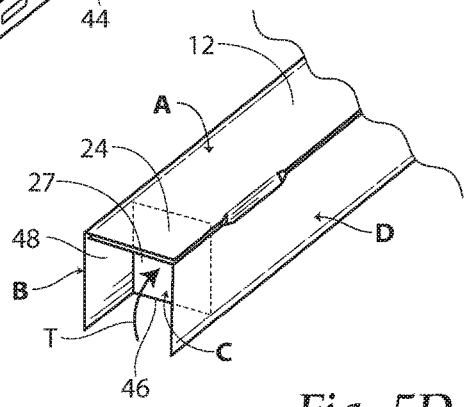
Fig. 5D
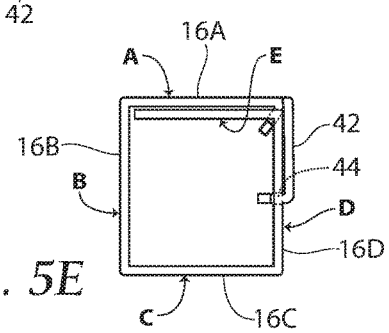
Fig. 5E

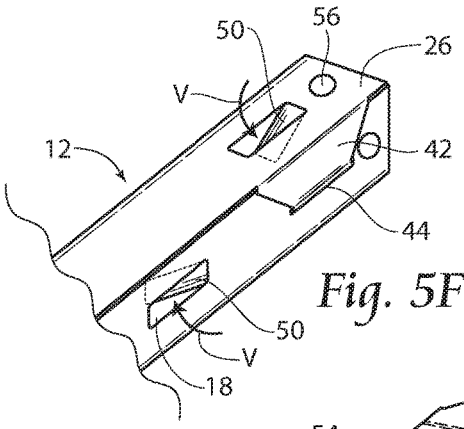
Fig. 5F
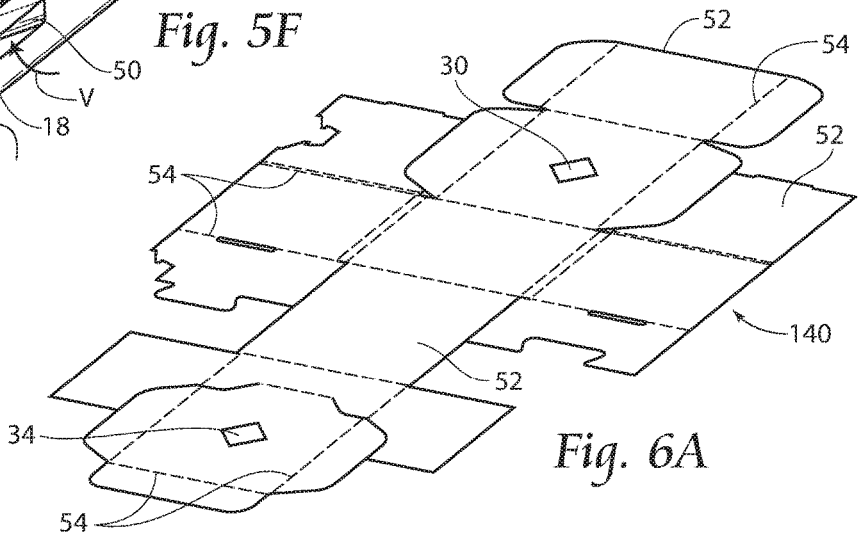
Fig. 6A
Fig. 6B
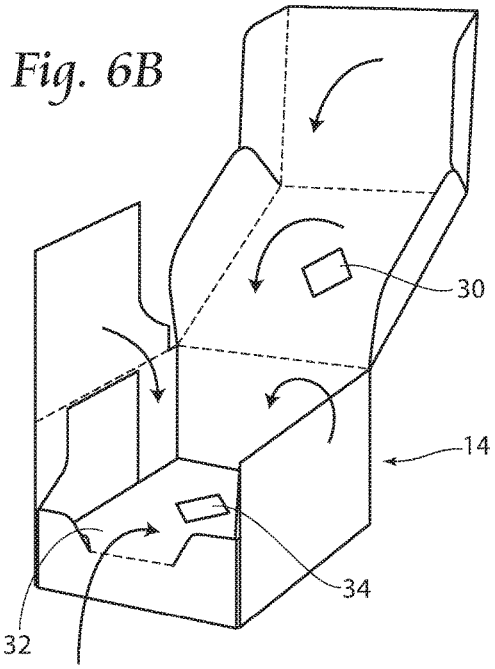
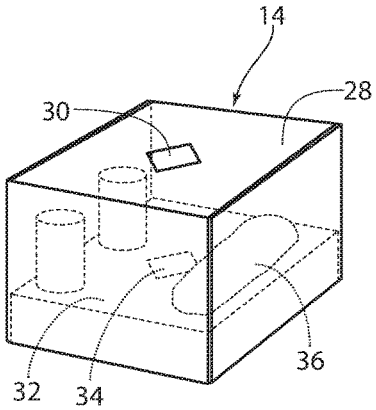
Fig. 6C

BALLOON DISPLAY STRUCTURE

RELATED APPLICATIONS

This application is a divisional of co-pending patent application Ser. No. 15/176,883, filed 8 Jun. 2016.

BACKGROUND OF THE INVENTION

The present invention relates to decorating supplies, and more particularly to a free-standing display to support and arrange balloons. The use of balloons, particularly helium-filled balloons, has long been popular for the purpose of party decoration, or other celebratory occasions. Currently, the cost of helium has risen, due in part to an increased demand in certain manufacturing segments. This has caused a shortage in available affordable helium for use in balloons. The consumer of helium-filled balloons may wish for a more cost effective alternative to the helium-filled balloon. One such solution involves the artful display of non-helium filled balloons. A non-helium-filled balloon may be held upright by a stick or other rigid member to simulate the upright condition of helium-filled balloons. Since air-filled balloons on sticks do not self arrange themselves or hold themselves erect in the manner of helium-filled balloons, greater care by the user to create a pleasing display is necessary. For example, a display structure and method of using such a structure may be used to gather and arrange non-helium-filled balloons in an agreeable manner to mimic the effect of helium-filled balloons, yet avoid the cost and scarcity of helium. Such a structure may be used in many settings and in many display concepts.

SUMMARY OF THE INVENTION

The present invention is directed to a balloon display structure and method of use. The present invention may also be considered to be a display structure blank and a method of making a display structure made therefrom. In particular, the display structure is for use in arranging and supporting non-helium-filled balloons, although helium-filled balloons may also be used, if desired. The display structure includes a base member and an upstanding member. As constructed, the upstanding member includes a plurality of sides having elongate apertures therein. The elongate apertures are arranged to receive air-filled balloons, particularly those supported on sticks. The upstanding member may be of various shapes and sizes, but is preferably an elongate structure of a predetermined length. The upstanding member may further include a brace member to retain the upstanding member in a non-collapsed condition. A base member for the present display structure includes a top surface having a base hole sized and shaped to receive an end of the upstanding member to thereby support the upstanding member in display condition.

The base member may be of any practical shape, and may preferably include an internal raised shelf member to impart rigidity and stability to the base. The raised shelf member further includes a shelf hole sized and shaped to receive an end of the upstanding member when the upstanding member is also received in the base hole. Further, the raised shelf member may be used to support various weights as may be employed by the user, when warranted, to minimize tip over of the display structure.

The display structure may be packaged in a collapsed condition and constructed on site by the user. When in the collapsed condition, the display structure includes an upstanding member blank and a base member blank made from rigid cardstock or cardboard. The upstanding member blank includes a first end and a second end with a plurality of elongate segments perpendicular to the ends. First, second, third and fourth fold lines are parallel to the elongate segments and define first, second, third, fourth and fifth segments. The first segment includes laterally extending tab members which are arranged for engagement in slots in the fourth segment. The blank may also include a lateral fold line on one end of a selected segment the fold line defines a brace member. Elongated apertures may be provided on one or more of the segments. The upstanding member blank is convertible to an upstanding member by folding the blank along the parallel fold lines and inserting the tab members into each respective slot.

The base member blank includes a plurality of segments having fold lines, with at least two segments each having a hole sized and configured to receive an end of a constructed upstanding member. The base member blank is convertible to a base member by folding the base member blank along the fold lines and aligning the holes.

A method of using the display structure includes the steps of:

constructing a base member having a top surface, the top surface having hole therein; constructing an upstanding member, the upstanding member having a plurality of sides, a first end and a second end, and wherein at least one of the plurality of sides includes at least one elongate aperture therein; inserting the first end of the upstanding member into the hole on the base member; providing at least one filled balloon mounted on a stick; and inserting the stick in the at least one elongate aperture. The method may further include the steps of providing the base member with a raised shelf member having a shelf hole sized and shaped to receive an end of the upstanding member and resting a weight member on the raised shelf member. Further steps include providing the second end of the upstanding member with at least one opening, providing a helium filled balloon on a string, inserting the string in the opening.

BRIEF DESCRIPTION OF THE DRAWINGS

FIG. 5A is a perspective view of the upstanding member blank prior to assembly.

FIGS. 5B and 5C are views illustrating assembly of the upstanding member blank illustrated in FIG. 5A.

FIG. 5D is a fragmentary view of an end of the upstanding member illustrated in FIGS. 5A-5E, and showing a stability brace in place.

FIG. 5E is an end view of the component illustrated in FIG. 5A-5C in assembled condition.

FIG. 5F is a fragmentary view of an end of the upstanding member illustrated in FIGS. 5A-5E and showing movement of aperture covers to thereby open the apertures.

FIG. 6A is a perspective view of the base member blank prior to assembly.

FIG. 6B is a view illustrating construction of the base member blank illustrated in FIG. 6A.

FIG. 6C is a perspective view of the base member illustrated in FIGS. 6A and 6B in assembled condition with phantom lines showing the internal raised shelf member and use of weights.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
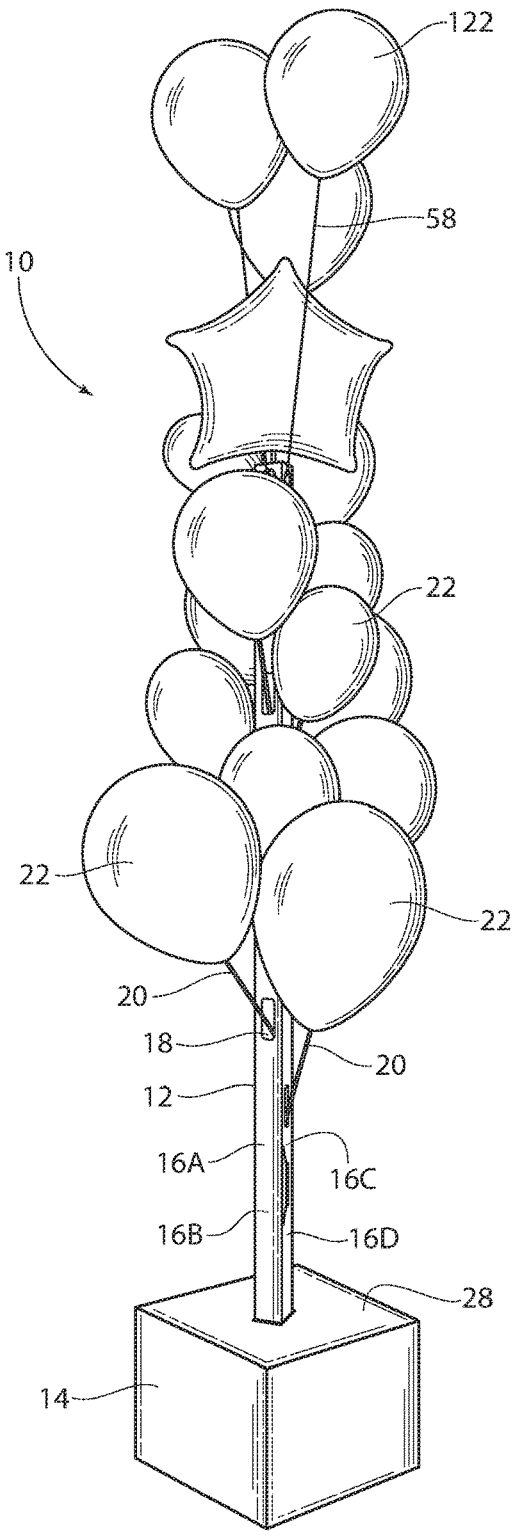
FIG. 1 is a perspective view of the present invention in use and supporting balloons.

The present invention provides a balloon display structure and method of use. In particular, the display structure is for use in arranging and supporting non-helium-filled balloons. With attention to FIGS. 1-3, a display structure 10 according to the present invention may be seen. As shown, the display structure 10 preferably includes an upstanding member 12 and a base member 14 adapted to receive and support the upstanding member 12. The upstanding member 12 includes plurality of sides 16A, 16B, 16C, 16D with at least one of the sides 16A, 16B, 16C, 16D having at least one elongate aperture 18 therein. Apertures 18 for use with the present invention may be of any suitable size and shape, but are shown as preferably of a generally elongated rectangular shape to receive a stick 20 holding an air-filled balloon 22. The elongate shape of the apertures 18 provides optimal flexibility for the user (not shown) to arrange the balloons 22 in a tasteful manner. Moreover, the upstanding member 12 may be of various shapes and sizes, but is preferably an elongate structure of a predetermined length and having a first end 24 and a second end 26. The second end 26 may include at least one string opening 56. The string opening 56 allows the user to attach other decorative elements to the display structure 10, such as the helium filled balloons 122 on a string 58 shown in FIGS. 1 and 8. The first end 24 may include a brace member 27 (see FIG. 5D) to retain the upstanding member 12 in a non-collapsed condition, as will be discussed.

Figure 2:
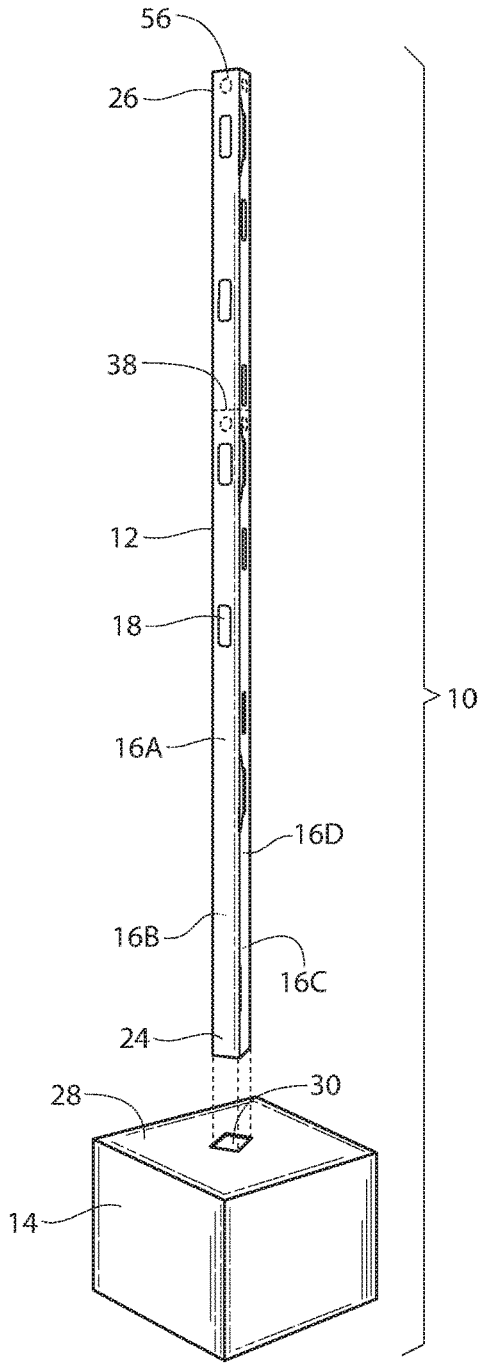
FIG. 2 is an exploded view of the display structure illustrated in FIG. 1 and showing its component parts.
Figure 3:
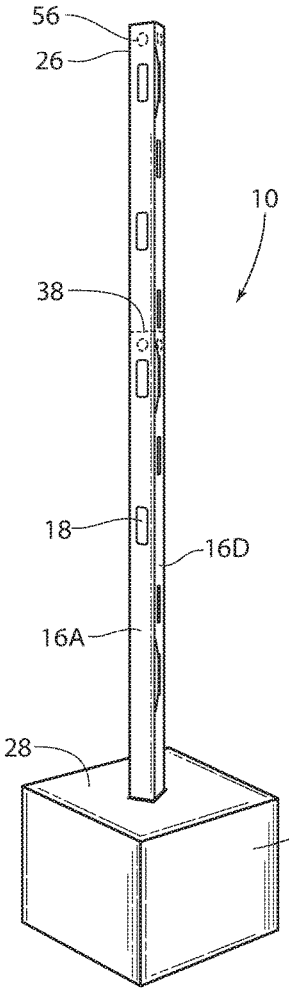
FIG. 3 is a view similar to that of FIG. 1, but without balloons in place.
Figure 9:
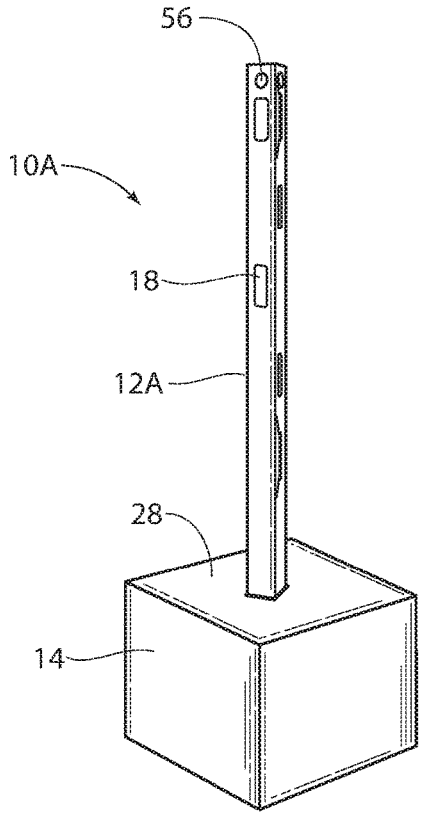
FIG. 9 is a perspective view similar to that of FIG. 3, but showing an upstanding member severed along a circumferential perforation and having a reduced height.
Figure 10:
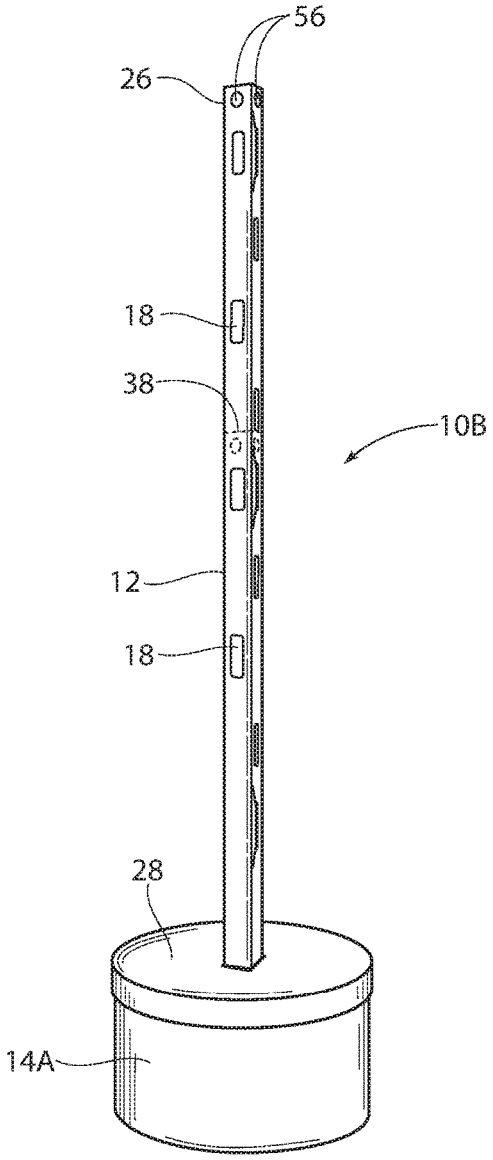
FIG. 10 is a perspective view similar to that of FIG. 3, but showing an alternative base member.

With particular attention to FIG. 2, the base member 14 may be seen to include a top surface 28 having a base hole 30 sized and shaped to receive an end 24, 26 of the upstanding member 12 to thereby support the upstanding member 12 in display condition. The base member 14 may be of any practical shape, such as the generally cube structure seen in the drawings, but it is within the scope of the invention for the base member 14 to be of various practical shapes and sizes, such as the drum-like base 14A shown in FIG. 10, by way of non-limiting example. Moreover, the base member 14 may further include an internal raised shelf member 32, such as that illustrated in FIG. 6C. The raised shelf member 32 imparts rigidity and stability to the base member 14 and further includes a shelf hole 34 sized and shaped to receive an end 24, 26 of the upstanding member 12. The shelf hole 34 is preferably positioned to be in axial alignment with the base hole 30, such that when an end 24, 26 of the upstanding member 12 is inserted in the base hole 30 it may be concurrently inserted into the shelf hole 34. This arrangement provides stability to the upstanding member 12 during display. Further, the raised shelf member 32 may be used to support various weights 36 (see FIG. 6C), if desired by the user, to increase stability and reduce tip-over of the display structure 10 in use. The upstanding member 12 may also include at least one circumferential perforation line 38. The circumferential perforation line 38 allows the user to separate the upstanding member 12 along the perforation line 38 such that the user may vary the display 10 height. FIG. 9 illustrates an upstanding member 12A wherein a user has separated the upstanding member 12 along the circumferential perforation line 38 with a lower portion 12A remaining. The display 10A shown in FIG. 9 is of a lesser length than that shown in FIGS. 1-3.

Figure 4A:
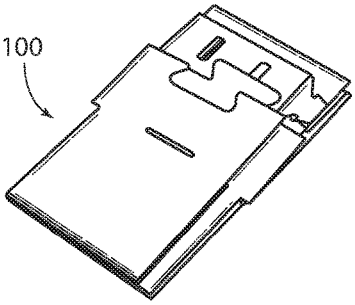
FIG. 4A is a perspective view of the component blanks of the display structure in condition for shipping.
Figure 4B:
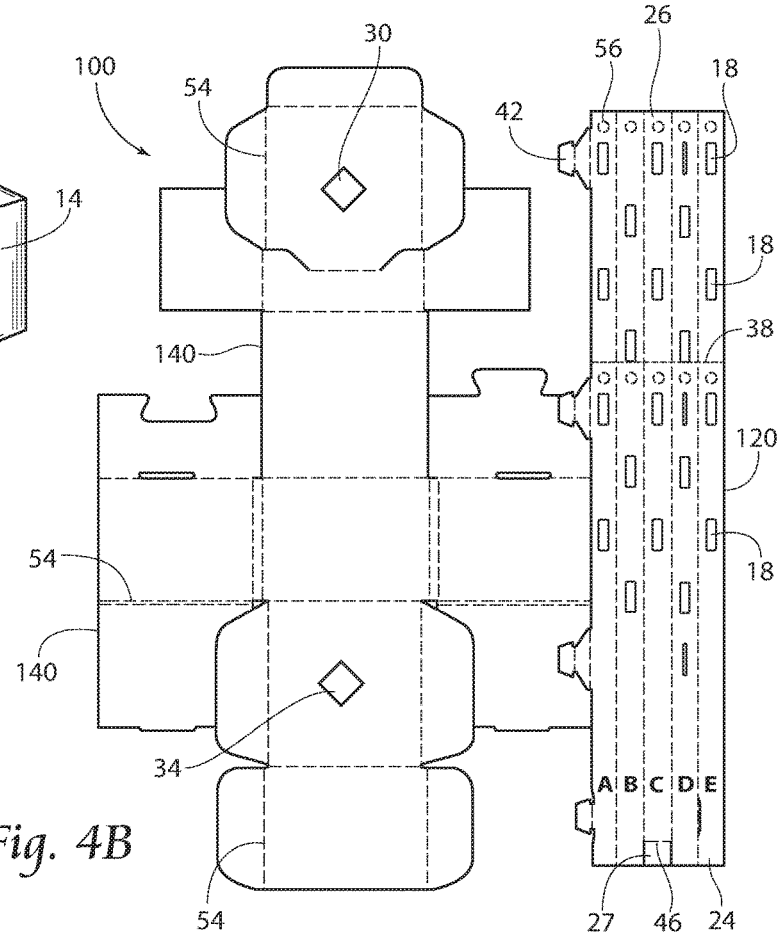
FIG. 4B is a plan view of the component blanks of the display structure prior to assembly.

With attention now to FIGS. 4A-7, steps to construct a display structure 10 according to the present invention may be seen. FIG. 4A illustrates the display structure 10 as packaged and folded in collapsed condition as a display structure blank 100 ready to be constructed on site by the user (not shown). FIG. 4B shows the display structure blank 100 in unfolded condition and having an upstanding member blank 120 and a base member blank 140. The blanks 120, 140 may be made of any suitably rigid but foldable material that is easily die-cut to form the blanks 120, 140, such as rigid cardstock, cardboard or the like. As is seen in FIG. 5A-5F, the upstanding member blank 120 includes a first end 24 and a second end 26 with a plurality of elongate segments A, B, C, D, E perpendicular thereto. First, second, third and fourth fold lines 40 are parallel to the elongate segments A, B, C, D, E and define the first, second, third, fourth and fifth segments, A, B, C, D, E, respectively. The first segment A includes laterally extending tab members 42 which are arranged for engagement in slots 44 in the fourth segment D. As shown, the upstanding member blank 120 also includes a lateral fold line 46 on one end 24, 26 of a selected segment A, B, C, D, E, and shown on the first end 24 of segment C in these views. The lateral fold line 46 defines the aforementioned brace member 27 to retain the assembled upstanding member 12 in a non-collapsed condition, as will be discussed with reference to FIG. 5D. The upstanding member blank 120 is convertible to an upstanding member 12 by folding the upstanding member blank 120 along the parallel fold lines 40, as is shown in FIG. 5B, and inserting the tab members 42 into each respective slot 44 (see FIG. 5C).

After the upstanding member 12 is formed, and as seen in FIG. 5D, the brace member 27 is moved along the lateral fold line 46 in the direction of arrow T and into the cavity 48 of the upstanding member 12. When positioned in the cavity 48, the brace member 27 assists in keeping the upstanding member 12 in constructed condition and to withstand collapse. As mentioned, elongate apertures 18 are provided on one or more of the 35 segments A, B, C, D, E such that when constructed, the elongate apertures 18 are positioned about the upstanding member 12 in the sides 16A, 16B, 16C, 16D. FIG. 5F illustrates an enlarged fragmentary view of the second end 26 of the upstanding member 12. As shown, the elongate apertures 18 may each be provided with a moveable tab 50. The tab 50 is moveable in the direction of arrow V when access to the elongate apertures 18 is desired. The tabs 50 cover the elongate apertures 18 during shipment and whenever access to the elongate apertures 18 is not required. The tabs 50 provide a covering over unused elongate apertures 18 so that there are no unsightly open elongate apertures 18 during display. Such an arrangement may be desired when for example, a user desires a top-heavy display to allow sightlines under the display. In such instances, elongate apertures 18 positioned lower on the upstanding member 12 may remain unopened and with the tabs 50 in place for a more attractive look. As is further seen in FIG. 5F, each tab 50 may be punched inward in the direction of arrow V while also remaining attached to the respective elongate aperture 18. The inward opened tabs 50 also add friction for the balloon sticks 20 when inserted, to thereby aid in their position and security.

FIGS. 6A-6C illustrate the base member blank 140 and its assembly. As shown in FIG. 6A, the base member blank 140 includes a plurality of segments 52 having fold lines 54, with at least two segments 52 each having a hole 30, 34 sized and configured to receive an end 24, 26 of a constructed upstanding member 12. The base member blank 140 is convertible to a base member 14 by folding the base member blank 140 along the fold lines 54 and aligning the holes 30, 34 (see FIG. 6B).

Figure 7:
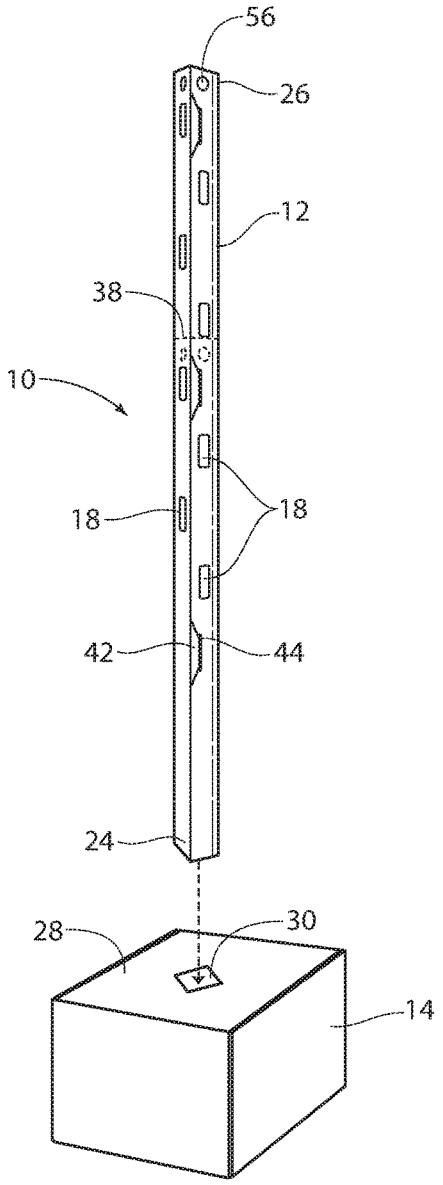
FIG. 7 is a perspective view illustrating final assembly of display structure and showing an end of the upstanding member being inserted into the base member.
Figure 8:
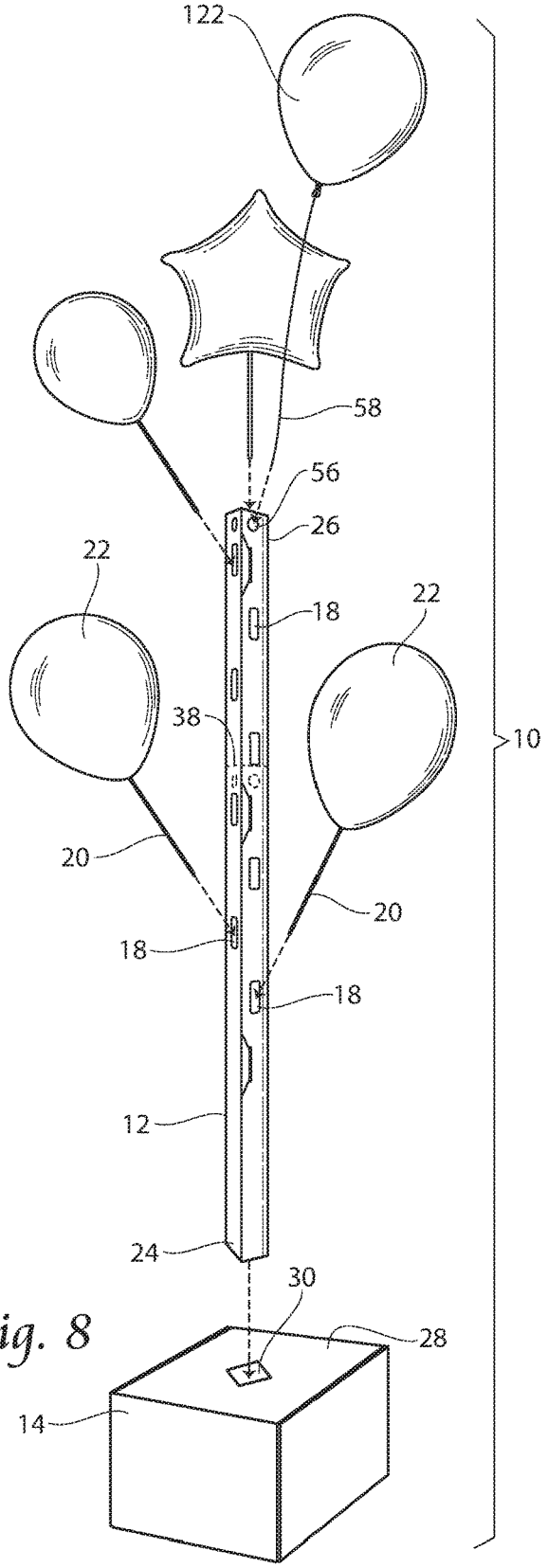
FIG. 8 is a view similar to that of FIG. 7, but showing air-filled balloons on sticks being inserted into elongate apertures on the upstanding member and helium-filled balloons into the openings.

The present invention also provides a method of using the display structure 10 described herein. The method includes the steps of:

constructing a base member 14 as shown in FIGS. 6A-6C wherein the base member 14 includes a top surface 28 having base hole 30 therein;

constructing an upstanding member 12 as shown in FIGS. 5A-5F, the upstanding member 12 having a plurality of sides 16A, 16B, 16C, 16D, a first end 24 and a second end 26, and wherein at least one of the plurality of sides 16A, 16B, 16C, 16D includes at least one elongate aperture 18 therein;

inserting the first end 24 of the upstanding member 12 into the base hole 30 of the base member 14, as seen in FIG. 7;

providing at least one air-filled balloon 22 mounted on a stick 20; and inserting the stick 20 in the at least one elongate aperture 18, as seen in FIG. 8.

The method may further include the steps of providing the base member 14 with an internal raised shelf member 32 having a shelf hole 34 sized and shaped to receive an end 24, 26 of the upstanding member 12. A further step includes resting a weight member 36 on the raised shelf member 32. Further steps include providing the second end 26 of the upstanding member 12 with at least one string opening 56, providing a helium-filled balloon 122 on a string 58, inserting the string 58 in the string opening 56, as shown in FIG. 8.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A method of using a balloon display structure comprising the steps of:

providing a base member, said base member having a top surface including a base hole therein;

providing a blank sheet, said blank sheet comprises a first side having plurality of tab members, a second side having a plurality of slots formed therein, and a brace member located at a first end of the blank sheet, and a first elongated aperture formed in the blank sheet;

folding said blank sheet into a post defining an upstanding member, said upstanding member having a plurality of side walls, the first end, a second end, wherein one of said plurality of side walls includes a portion of the first side and a portion of the second side;

wherein the first elongated aperture is defined in another side wall from said plurality of side walls;

inserting each tab member into a corresponding slot from said plurality of slots respectively; rotating the brace member from the first end towards the second end into a cavity of the upstanding member, wherein the brace member retains the upstanding member in a non-collapsed condition;

inserting said first end of said upstanding member into said base hole in order to support the upstanding member upright in a display condition;

providing a first inflated balloon, said first balloon being mounted on a stick; inserting said stick into said first elongated aperture;

wherein said first elongated aperture comprises a tab pivotally attached thereto;

engaging the stick with the tab to maintain the first balloon in a desired position.

2. The method of claim 1, further comprising the step of: providing said base member with a raised shelf member, said raised shelf member having a shelf hole therein arranged to receive said first end of said upstanding member.

3. The method of claim 2, further comprising the steps of: providing a weight member and resting said weight member on said raised shelf member.

4. The method of claim 3, further comprising the steps of: providing said second end of said upstanding member with a first string opening; providing a second inflated balloon on a string; and inserting said string in said first string opening.

5. The method of claim 4, wherein the first string opening is one of a plurality of string openings formed in the upstanding member.

6. The method of claim 1, wherein the first elongated aperture is one of a plurality of elongated apertures formed in the top end of the upstanding member.

* * * * *